United States Patent [19]

Bushnell

[11] Patent Number: 4,477,074

[45] Date of Patent: Oct. 16, 1984

[54] PORTABLE BARBELL AND DUMBBELL RACK

[76] Inventor: Donald D. Bushnell, 733 S. Jones, Mesa, Ariz. 85204

[21] Appl. No.: 397,126

[22] Filed: Jul. 12, 1982

[51] Int. Cl.[3] ..... A63B 13/00

[52] U.S. Cl. ..... 272/123; 272/122

[58] Field of Search ..... 272/122, 123, 144, 93, 272/117

[56] References Cited

U.S. PATENT DOCUMENTS

| | | | |
|---|---|---|---|
| 4,249,726 | 2/1981 | Faust | 272/123 |
| 4,257,590 | 3/1981 | Sullivan et al. | 272/123 X |
| 4,369,966 | 1/1983 | Silberman et al. | 272/123 X |

OTHER PUBLICATIONS

No. 9408 Deluxe Supine Bench; Universal 1981-1982 Catalog; Catalog Digest; p. 30, this catalogue was published Jun. 1, 1981.

Centurion 8,9,10-Station Systems-Universal Catalogue, 1981-1982, pp. 14,11.

*Primary Examiner*—Richard J. Apley

*Assistant Examiner*—William R. Browne

*Attorney, Agent, or Firm*—Drummond & Nissle

[57] ABSTRACT

A bench press apparatus having a bench carried on a frame. The apparatus includes two spaced apart upstanding members that have on their respective ends two spaced apart arms for receiving a barbell. Underneath the apparatus there is a support for supporting at least one dumbbell. Said support includes structure to prevent a dumbbell from moving laterally. On the underneath side of bench there is structure to support the bar of a barbell. The bar prevents the removal of a dumbbell from its support under the bench.

1 Claim, 4 Drawing Figures

FIG. 4
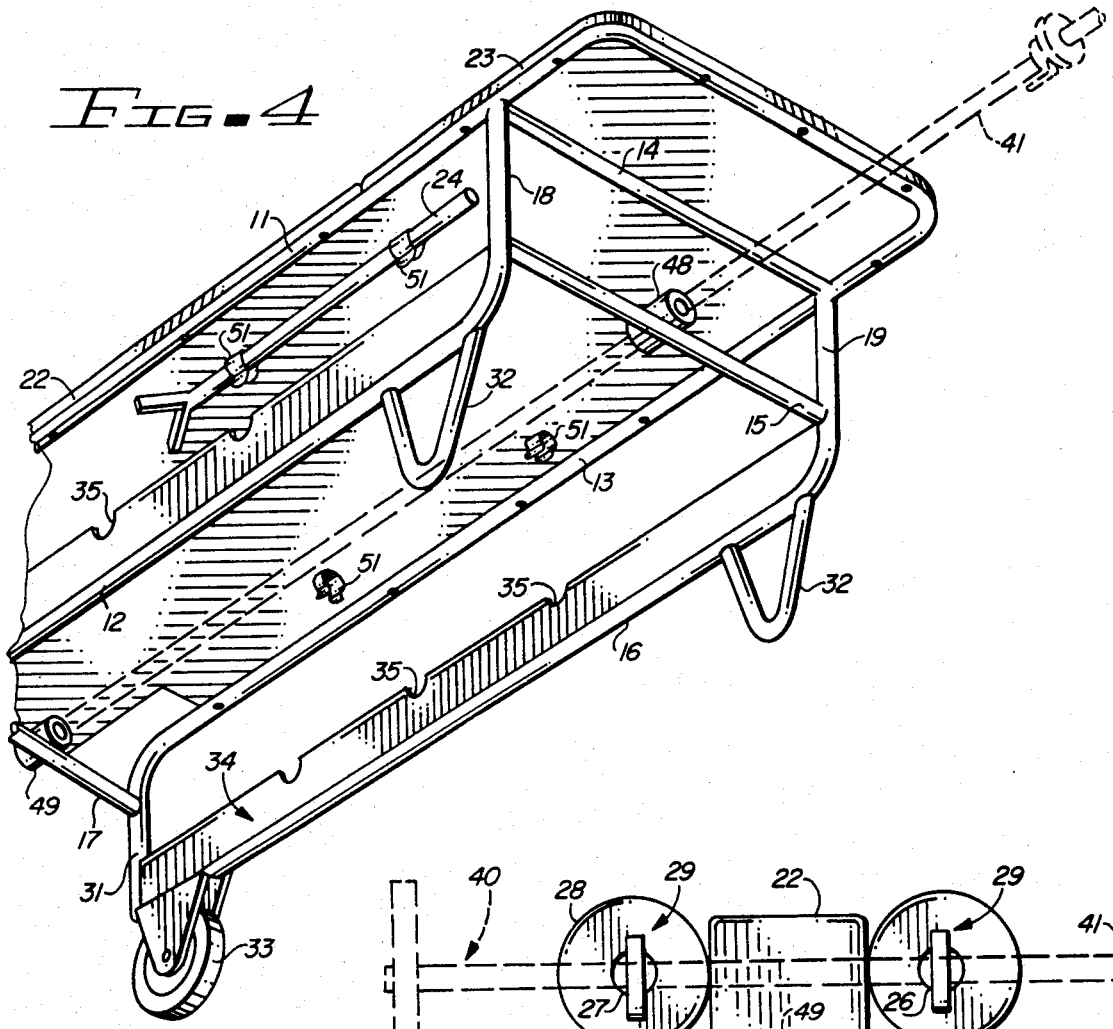
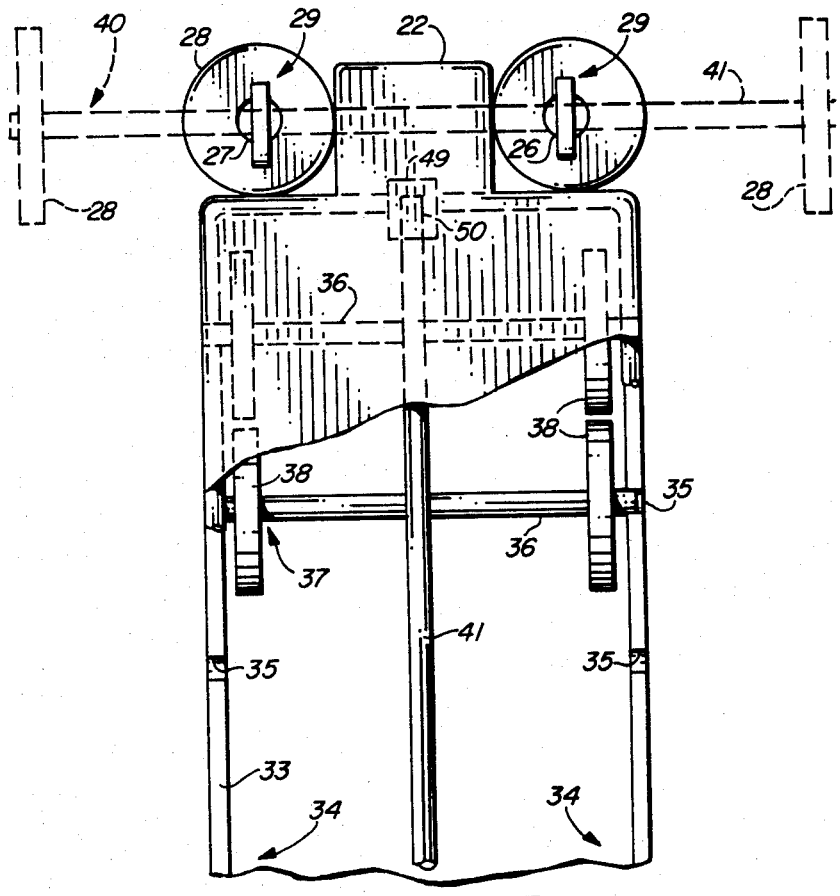
FIG. 5

PORTABLE BARBELL AND DUMBBELL RACK

This invention relates to exercise apparatus.

More particularly, the invention relates to portable bench press exercise apparatus which can be tipped on end to facilitate ready storage of the apparatus and which carries dumbbells and weights such that the dumbbells and weights remain locked in position on the bench press apparatus when the apparatus is tipped on end.

In another respect, the invention relates to bench press exercise apparatus which prevents the elongate weight supporting bar of a barbell from falling against the neck of an individual who is reclining on the apparatus and who, after grasping and then repeatedly raising and lowering the barbell with his arms, loses control of his arm muscles and is unable to maintain the barbell above his body.

Bench press exercise equipment is well known and normally includes an elongate horizontally disposed support surface or bench mounted on a low slung frame. A pair of parallel upstanding support rods are attached near one end of the frame, the rods being positioned to either side of the support surface. The upper end of each rod is Y-shaped so that the elongate bar of a barbell can be cradled in the Y's and maintained by the support rods in position above the elongate support surface. The Y's at the upper ends of the upstanding support rods normally contact the barbell bar at points inbetween weights carried on either end of the barbell bar.

During utilization of bench press exercise equipment a barbell carrying weights on either end thereof is first cradled in the Y-shaped supports at the upper ends of the barbell support rods. An individual then reclines on the support bench with his back and buttocks contacting the bench. An individual reclining on the bench normally has his knees bent so that his feet contact the ground beside the bench press apparatus and has his head positioned between the pair of upstanding support rods. After an individual has positioned himself on his back on the bench, he grasps the barbell bar with both hands, presses the barbell upwardly away from the support Y's and slightly forward toward his feet until he is supporting the barbell above his chest with his arms fully extended. At that point he lowers the barbell to a point adjacent his chest and then raises the barbell until his arms are again fully extended, i.e., he performs a "bench press". After a desired number of bench presses are performed, the individual returns the barbell to the Y-shaped cradles atop the upstanding barbell support rods. If the individual misjudges his physical condition, over extends himself and continues performing bench presses until his muscles no longer function, the barbell may, although still in the grasp of the individual, drop downwardly against the individual's neck. Strangulations have occurred in cases where the barbell bar settled across the individual's neck and the individual was, because he had "burned out" his arm muscles performing an excessive number of bench presses, unable to push the barbell up and away from his neck.

A problem long connected with the practice of lifting weights is the inconvenience associated with transporting weight lifting equipment from one location to another. Homeowners often have only limited living space and must remove weights from a storage area in order to utilize the weights and must then, after completing an exercise session, disassemble the weights and return them to the storage area. The continual transport of weight equipment to and from a storage area tends to discourage a person from utilizing the equipment.

Accordingly, it would be highly desirable to provide improved weight lifting apparatus which would permit compact, ready storage of weight lifting equipment and which would permit the weight lifting apparatus to be quickly and easily moved from one location to another.

It would also be highly desirable to provide improved bench press apparatus having a safety mechanism which would generally prevent a barbell from falling against the neck of an individual who performs an excessive number of bench presses, loses control of his arm muscles and is no longer able to support the barbell.

Therefore, it is a principal object of the instant invention to provide improved exercise apparatus.

Another object of the invention is to provide improved bench press exercise apparatus which can be compactly stored and readily moved from one location to another.

A further object of the invention is to provide improved bench press exercise apparatus which can receive and store dumbbells and can store the weights and bar comprising a barbell set.

Still another object of the invention is to provide improved bench press exercise apparatus which includes a safety mechanism for preventing the bar of a barbell from falling downwardly against the neck of an individual who inadvertently drops the barbell while performing bench presses or who completes an excessive number of bench presses and loses control of his musculature and, consequently, of the barbell.

These and other, further and more specific objects and advantages of the invention will be apparent to those skilled in the art from the following detailed description thereof, taken in conjunction with the drawings, in which:

FIG. 4 is a bottom perspective view of the apparatus of FIG. 2 further illustrating the storage of weight lifting equipment thereon; and FIG. 5 is a top view of a portion of the bench press apparatus of FIG. 2 depicting the position of a barbell and of dumbbells on the apparatus.

Figure 1:
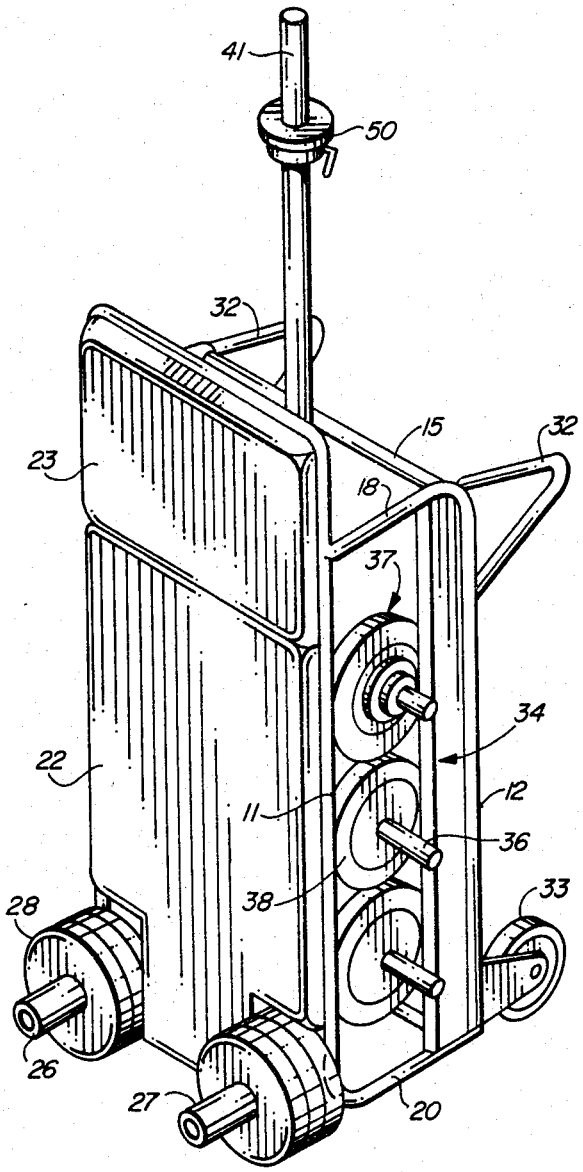
FIG. 1 is a perspective elevational view of bench press apparatus constructed in accordance with the principles of the present invention.

Briefly, in accordance with the invention, I provide improved bench press exercise apparatus. The apparatus includes a frame; an elongate generally horizontally disposed surface carried on the frame for supporting an individual reclining on said apparatus; an elongate bar adapted to receive weights at either end thereof; a pair of spaced upstanding rods carried and positioned on the frame such that a portion of the support surface lies thereinbetween, the rods having upper ends adapted to receive and maintain the elongate bar in position above the support surface; at least one barbell carried by the frame beneath the support surface and including an elongate barbell rod; means for maintaining the barbell in position on the frame beneath the support surface such that the barbell rod is generally parallel to the support surface, the barbell rod is prevented from moving generally horizontally, and the barbell rod can be upwardly displaced from the means for maintaining the barbell in position on the frame beneath the bench and may be removed from beneath the bench; and securing means mounted on the frame beneath the elongate support surface and adapted to slidably receive and secure the elongate bar in position above the barbell rod to prevent the barbell from being upwardly displaced.

In another embodiment of the invention, I provide improved portable bench press apparatus for assisting an individual in lifting weights. The apparatus includes a frame a first end and a second end, the second end contacting the ground; an elongate generally horizontally disposed surface carried on the frame for supporting an individual reclining on the apparatus; a pair of spaced upstanding rods carried and positioned on the frame such that a portion of the support surface lies thereinbetween, the rods having upper ends adapted to receive and maintain an elongate bar in position above the support surface, said elongate bar normally carrying weights at either end thereof; and a pair of ground engaging wheels rotatably connected to the first end of the frame and raising and maintaining said first end above the ground such that when the second end is lifted from the ground, the bench press apparatus may be moved about on the wheels. The frame of the apparatus may be shaped and dimensioned such that after the second end of the apparatus is lifted upwardly until the support surface is generally vertically disposed, the frame contacts the ground and the elongate apparatus remains fixed and free standing in position with the elongate support surface generally vertically disposed.

In still another embodiment of the invention, I provide improved bench press apparatus for assisting an individual in lifting weights. The apparatus includes, in combination, a frame; an elongate generally horizontally disposed surface carried on the frame for supporting an individual reclining on the apparatus; a pair of spaced, upstanding rods carried and positioned on the frame such that a portion of the support surface lies therebetween, the rods having upper ends adapted to receive and maintain an elongate bar in position above the support surface, the elongate bar normally carrying weights at either end thereof; and, at least one elongate safety member carried by and extending outwardly from one of the pair of spaced, upstanding rods between said upper end thereof and said horizontally disposed support surface to prevent the elongate bar from downwardly falling near said upstanding rods and against the neck of said individual reclining on the support surface when said elongate bar is being grasped by the individual.

Figure 3:
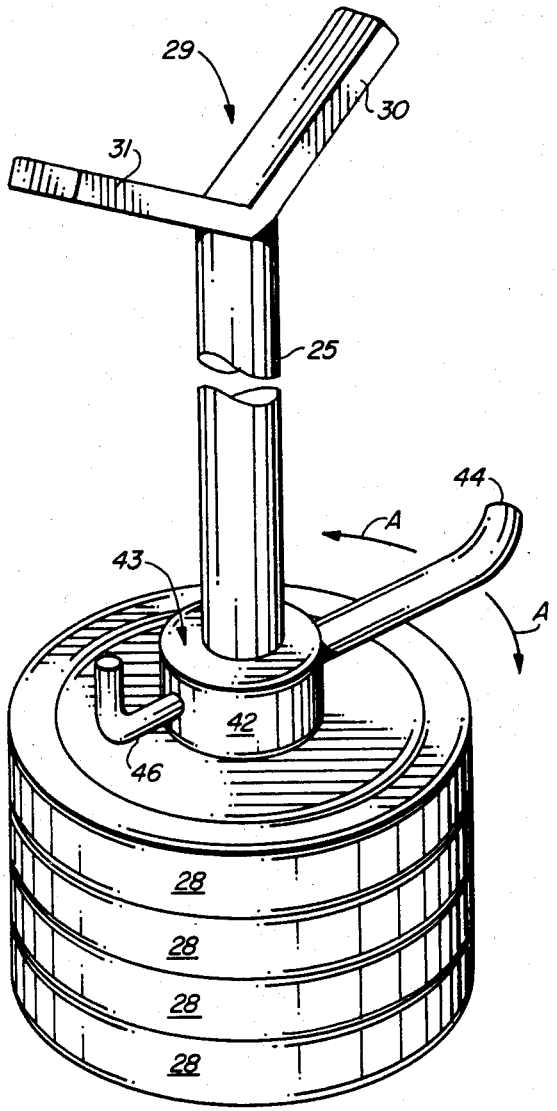
FIG. 3 is an enlarged view of a portion of the bench press apparatus of FIG. 2 illustrating further structural details thereof.
Figure 2:
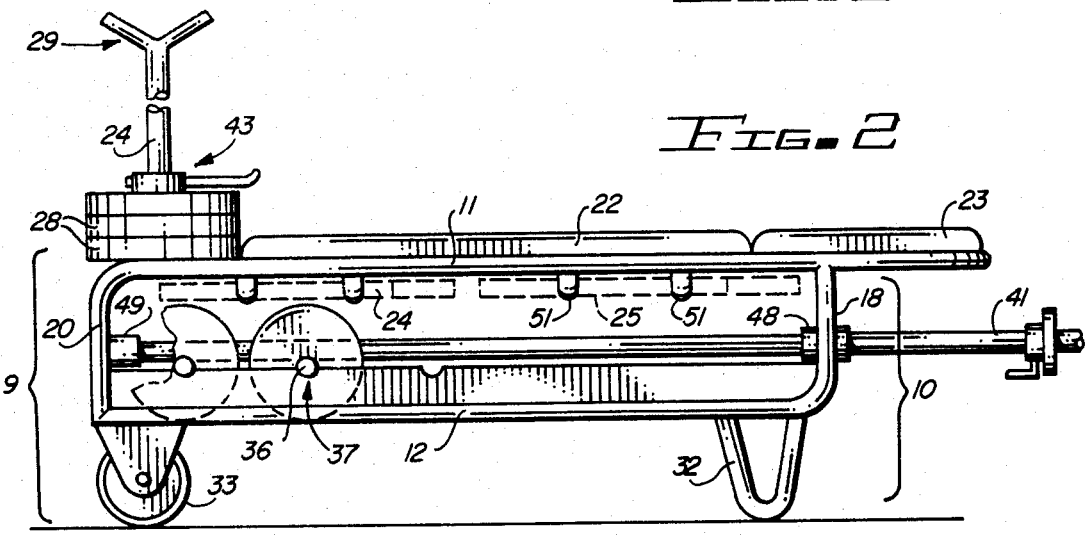
FIG. 2 is a side view of the apparatus of FIG. 1 oriented in position for a person to recline thereon to perform bench presses.

Turning now to the drawings, which depict the presently preferred embodiments of the invention for the purpose of illustrating the practice thereof and not by way of limitation of the scope of the invention, and in which like reference characters identify corresponding elements throughout the several views, FIGS. 1–5 illustrate the presently preferred embodiments of the bench press exercise apparatus of the invention including a frame having interconnected horizontal members 11–17 and vertical members 18–21 supporting a horizontally disposed support surface or bench surface including cushions 22, 23. One end 9 of the frame includes feet 32 while the other end 10 of the frame is provided with ground engaging wheels 33. Upstanding barbell support rods 24, 25 are slidably received and maintained in position by hollow collars 26, 27. When support rods 24, 25 are slidably inserted in cylindrical apertures in elongate collars 26, 27 rods 24, 25 are generally parallel to one another. In FIGS. 2 and 3 collars 26, 27 are obscured by weights 28 slidably stored in position on collars 26, 27. The upper end of each support rod 24, 25 includes a Y-shaped cradle 29 having outwardly projecting legs 30, 31. Upper edges 33 of elongate panels 34 are provided with semi-circular notches 35 sized to receive the ends of elongate rods 36 of dumbbells 37. Rods 36 of dumbbells 37 carry weights 38 at either end thereof. When dumbbells 37 are carried in notches 35 of the bench press apparatus as shown in FIG. 2, dumbbells 37 are generally prevented from being displaced horizontally but can still be lifted upwardly from notches 35 and removed from the bench press apparatus for use during an exercise period. Panel members 34 can be secured to members 12, 16 or otherwise maintained in position on the frame of the apparatus.

The bench press apparatus of the invention is, when it is oriented as shown in FIGS. 2, 4 and 5, utilized by first positioning a barbell (shown by dashed lines 40 in FIG. 5) in Y-shaped cradles 29 of upstanding support rods 24, 25. Barbell 40 includes an elongate rod 41 carrying weights 28 at either end thereof. An individual reclines on the bench press apparatus with his back and buttocks against and supported by bench cushions 22, 23 and with his head supported by cushion 22 between upstanding rods 24, 25. After he has reclined on cushions 22, 23 the individual grasps bar 41 of barbell 40 at points between rods 24, 25 and presses barbell 40 upwardly away from Y-shaped cradles 29 and forward toward his feet until his arms are fully extended and he is maintaining the barbell in position above his chest. Once the barbell is in position above his chest, the individual lowers the barbell to a position adjacent his chest and then presses the barbell upwardly to again fully extend his arms to return the barbell to its initial position above his chest. The lowering and raising of the barbell is termed a bench press. After the individual has performed a desired number of bench presses, he returns barbell 40 to Y-shaped cradles 29.

Sometimes an individual overestimates his fitness, performs an excessive number of bench presses, "burns out" his arm muscles and allows the barbell to fall against his body with bar 41 bearing against his neck. When an individual is alone and temporarily has no strength left in his arms due to performing an excessive number of bench presses, the individual can, if rod 41 falls against his neck, undergo self-strangulation. In order to guard against this occurrence, the bench press apparatus of the invention includes a pair of safety attachments 43, each including a cylindrical hollow collar member 42 slidably received by either of support rods 24, 25. Collar member 42 of each safety attachment 43 carries elongate arm 44. Collar 42 can be swiveled about rod 25 (or 24) in the directions of arrows A in FIG. 3 and can be temporarily secured in a desired position with thumbset screw 46. When the bench press apparatus of the invention is provided with safety attachments 43, the accidental self-strangulation of an individual using the bench press apparatus is generally avoided since arms 44 prevent rod 41 of barbell 40 from falling against the individual's neck. Attachments 43 either catch and hold rod 41 or, if rod barbell 40 falls in front of attachments 43 toward end 10 of the apparatus, cause barbell 40 to contact the chest of the individual reclining on the apparatus. In FIG. 2, if attachments 43 were not in place on the apparatus, weights 28 would perform the same function as attachments 43. Thus, attachments 43 could be made in any shape which would, after the attachment had been secured to one of rods 24, 25, result in a portion of the attachment extending outwardly from rod 24 or 25 toward end 10 of the apparatus such that rod 41 could not drop generally vertically against the neck of an individual performing bench presses on the apparatus. Similarly, attachments 43 would not necessarily have to be secured to rods 24, 25 but could be constructed to be attached to another portion of the frame of the apparatus and perform the same function.

To prepare the bench press apparatus of the invention for storage, weights 28 are removed from barbell 40 and slidably positioned on collars 26, 27 or stacked in a selected storage area. Elongate support rods 24, 25 are upwardly slid from hollow collars 26, 27 and pressed into flexible U-shaped snaps 51 attached to the bottom of cushions 22, 23. Rod 41 of barbell 40 is slid into and through hollow cylindrical collar 48. The end of rod 41 slid into and through collar 48 is received by collar 49. As shown in FIG. 5, cylindrical aperture 50 formed in collar 49 to receive one end of rod 41 does not pass completely through collar 49 and retains one end of rod 41 within collar 49. If desired, a thumbset screw similar to setscrew 46 can be included on collar 48 so that rod 41 can be fixedly detachably locked into the position shown in FIGS. 1, 2, 4 and 5. Collars 48, 49 are carried by and positioned on the frame of the bench press apparatus such that when bar 41 is inserted therein, bar 41 is positioned so that portions thereof are immediately adjacent bars 36 of dumbbells 37 carried on the frame in notches 35 of elongate panel members 34. After rod 41 is received by collars 48, 49, end 10 of the apparatus can be raised from the ground by grasping and lifting bar 41 near weight retainer 50. Once bar 41 is grasped and utilized to lift feet 32 from the ground, the apparatus can be rolled on wheels 33 to the desired storage location and turned on end to a position with the flat planar surfaces of cushions 22, 23 generally vertically oriented as depicted in FIG. 1. When the bench press exercise apparatus is tipped on end as shown in Fig. 1, rod 41 prevents dumbbells 37 from falling out of notches 35. Weights 28 help stabilize the bench press apparatus in the position shown in FIG. 1. Means may be provided to maintain weights 28 in the position shown in FIG. 1 and to prevent weights 28 from sliding away from cushion 22 and off of cylindrical collars 26, 27. As shown in FIG. 1, when the bench press exercise apparatus is tipped on end wheels 31, frame members 20, 21, 17 and, if desired, weights 28 contact the ground and maintain the apparatus in position.

Safety members 43 can be formed to be slidably received by collars 26, 27 and the apparatus of the invention may include other means to detachably secure members 43 thereon for storage.

Having described my invention in such a clear and concise manner as to enable those skilled in the art to understand and practice it, and having described the presently preferred embodiments thereof, I claim:

1. Bench press apparatus for assisting an individual in lifting a barbell, said bench press apparatus comprising, in combination, (a) a frame;

(b) an elongate generally horizontally disposed bench carried on said frame for supporting an individual reclining on said apparatus;

(c) a pair of spaced upstanding rods carried and positioned on said frame such that a portion of said support bench lies thereinbetween, said rods having upper ends provided with barbell support surfaces, said support surfaces being shaped, contoured and dimensioned such that a barbell may be maintained in position above said support bench;

(d) at least one dumbbell carried by said frame beneath said bench and including an elongate dumbbell rod (e) means for maintaining said at least one dumbbell in position on said frame beneath said bench such that (i) said at least one dumbbell rod is generally parallel to said support bench, and (ii) said at least one dumbbell rod can be upwardly displaced from said means for maintaining said at least one dumbbell in position on said frame beneath said bench and may be removed from beneath said bench, said means including at least one horizontally disposed member shaped, contoured and dimensioned to at least partially engage said at least one dumbbell and prevent said at least one dumbbell from moving in a direction of travel generally perpendicular to the longitudinal axis of said at least one dumbbell rod; and, (f) securing means mounted on said frame beneath said elongate support bench and adapted to slidably receive and secure said elongate bar in position above said dumbbell rod to prevent said dumbbell from being upwardly displaced.

* * * * *